US008371355B2

(12) United States Patent
Santoro et al.

(10) Patent No.: US 8,371,355 B2
(45) Date of Patent: Feb. 12, 2013

(54) WINDOW SHADE ASSEMBLY WITH RE-CHANNELING SYSTEM AND SINGLE SEAL STRIP OF WRAPPING MATERIAL

(75) Inventors: Corina Santoro, Delmar, NY (US); Richard D. Watkins, Lake Luzerne, NY (US); John A. Corey, Melrose, NY (US)

(73) Assignee: Comfortex Corporation Watervliet NY (US)

( * ) Notice: Subject to any disclaimer, the term of this patent is extended or adjusted under 35 U.S.C. 154(b) by 133 days.

(21) Appl. No.: 12/835,147

(22) Filed: Jul. 13, 2010

(65) Prior Publication Data

US 2012/0012261 A1 Jan. 19, 2012

(51) Int. Cl.
*E06B 9/36* (2006.01)

(52) U.S. Cl. ..... 160/168.1; 160/269

(58) Field of Classification Search ..... 160/267.1, 160/268.1, 269, 271, 272, 273.1, 41, 31, 160/121.1, 23.1
See application file for complete search history.

(56) References Cited

U.S. PATENT DOCUMENTS

| | | | | | |
|---|---|---|---|---|---|
| 1,673,325 | A | * | 6/1928 | Godley | 362/288 |
| 1,810,848 | A | * | 6/1931 | Nye | 160/269 |
| 2,041,105 | A | * | 5/1936 | Barnhart | 160/31 |
| 3,292,685 | A | * | 12/1966 | Clark | 160/26 |
| 4,357,978 | A | | 11/1982 | Keller et al. | |
| 4,458,739 | A | * | 7/1984 | Murray et al. | 160/23.1 |
| 4,516,618 | A | | 5/1985 | Gardner et al. | |
| 4,526,618 | A | | 7/1985 | Keshavan et al. | |
| 4,651,796 | A | | 3/1987 | Gardner et al. | |
| 4,987,943 | A | * | 1/1991 | Charest | 160/269 |
| 5,015,317 | A | | 5/1991 | Corey et al. | |
| 5,106,444 | A | | 4/1992 | Corey et al. | |
| 5,117,892 | A | | 6/1992 | Murray | |
| 5,135,461 | A | | 8/1992 | Corey et al. | |
| 5,193,601 | A | | 3/1993 | Corey et al. | |
| 5,482,104 | A | * | 1/1996 | Lichy | 160/273.1 |
| 6,189,592 | B1 | | 2/2001 | Domel | |
| 6,651,720 | B1 | | 11/2003 | DiSilvestro et al. | |
| D625,435 | S | | 10/2010 | Corey et al. | |
| D625,436 | S | | 10/2010 | Corey et al. | |
| 2012/0012261 | A1 | * | 1/2012 | Santoro et al. | 160/272 |

OTHER PUBLICATIONS

Window Quilt Insulated Shades, Product Descriptions, www.windowquilt.com.

* cited by examiner

*Primary Examiner* — Blair M. Johnson
(74) *Attorney, Agent, or Firm* — Hoffman Warnick LLC

(57) ABSTRACT

A window shade assembly includes a flexible shade material having a pair of non-beaded vertical edges positioned in a pair of opposed vertical side channels. A re-channeling system includes a lip to at least partially define a plane of the flexible shade material within the side channels, and a bottom rail irremovably and slidingly received in each side channel. The side channels can be two parts. A single resilient seal strip is used with the side channels to seal the flexible shade material. The seal strip can be an edge of the flexible wrapping material for the side channels.

12 Claims, 8 Drawing Sheets

WINDOW SHADE ASSEMBLY WITH RE-CHANNELING SYSTEM AND SINGLE SEAL STRIP OF WRAPPING MATERIAL

BACKGROUND

1. Technical Field

The invention relates generally to window shades, and more particularly, to a window shade assembly having a re-channeling system for a flexible shade material with non-beaded edges, two-part side channels and a single seal strip that may include an edge of flexible wrapping material used on the side channels.

2. Background Art

One of the older forms of window shading includes a roller shade, in which a flat, rectangular piece of material (typically fabric or film) is stored in rolled form on a substantially cylindrical roller core at the top edge of a window and unrolled when desired to cover the window to block a view or modulate light. These window shades are inexpensive to manufacture and can utilize a wide range of shade materials, some of which can be decorated with images or be made environmentally responsive, e.g., with self-darkening films. Spring-loaded and ratcheted roller cores are common because they eliminate the need for any visible actuating mechanism or the safety concerns of exposed cords. Corded clutch drives are also popular.

One drawback of typical roller shades is that they do not provide any significant thermal benefit, and only partial light control. These limitations derive from two causes: the thin, single-layer nature of rollable fabrics and films, and the open gaps at the sides (and also often at the top and bottom) between the shade material and the window aperture. In order to address the thermal issue, a number of solutions have been pursued. One approach was the development of double-depth cellular window shades that provide an insulating quality to the shade material. Despite their added thermal characteristics, however, edge gaps that allow free air movement around the shading material limit the thermal and light-blocking effectiveness of these window shades.

Another approach to provide both improved thermal and light control characteristics was to add opposing C-channels that are coupled to the window frame and slidingly engage edges of the shade material. In such systems, the shade material's edge is typically beaded (increasing its thickness along the edges) and the bead is retained in a closed C-shaped channel mounted to the window frame. The beading keeps the otherwise flaccid shade material constrained to be held taut and flat between the tracks, and creates a contact seal along that junction. Unfortunately, such beading makes the shade material roll up poorly as the thick beading controls the roll-up, instead of the flat area of the main material portion (unless that main portion is similarly thickened, as for instance by quilting, to a dimension not less than the bead thickness). Consequently, the roll is much larger for the same deployed length (called the "drop") and the beads, being narrow, tend to fall in a disorderly way when rolling, causing wrinkles and uneven deployment. A "re-railer" for guiding a beaded-edge shade back into the C-channel if it is dislodged has also been developed. However, known re-railers are bulky and do not operate without an edge bead present, to be pulled back into the channel.

Another disadvantage to known C-channel tracks is that they are visually obtrusive and present a high level of drag to deployment that makes simple gravity-driven systems unreliable. The large roll and tracks, limited fabric options (typically thick quilts, tolerant of edge beading and subsequent wrinkling) and operational limitations of such bead-and-C systems have limited their acceptance in the market to a very narrow segment that values energy savings highly over other functions or appearance.

Some C-channel systems have been applied to non-beaded shade material. In these systems, however, where the edges of the shade material dislodges from the C-channels, re-channeling is extremely difficult, so these channels are typically made with a very deep engagement to minimize the risk of dislodging. In addition, like the beaded versions, these C-channels are visually obtrusive, may occupy a large part of the window area and present a high level of drag to deployment that makes gravity-driven systems unreliable.

BRIEF SUMMARY

A first aspect of the invention provides a window shade assembly comprising: a headrail including a roller core wrapped with a flexible shade material having a pair of non-beaded vertical edges; a pair of opposed vertical side channels open in a direction facing one another and configured to be mounted to a surrounding frame, each side channel receiving a respective non-beaded vertical edge of the flexible shade material; a lip positioned at a vertical distance from an outer surface of the roller core to at least partially define a plane of the flexible shade material within the side channels; and a bottom rail coupled to a free edge of the flexible shade material and slidingly received in each side channel, the bottom rail including an end member at each end thereof to prevent removal from the side channels, whereby in response to at least one of the non-beaded vertical edges being at least partially removed from a side channel, the lip and bottom rail position the flexible shade material for re-channeling into the side channels upon rolling of the flexible shade material onto the roller core.

A second aspect of the invention provides a window shade assembly comprising: a headrail including a roller core wrapped with a flexible shade material having a pair of non-beaded vertical edges; a pair of opposed vertical side channels open in a direction facing one another and configured to be mounted to a surrounding frame, each side channel receiving a respective non-beaded vertical edge of the flexible shade material; and a single resilient seal strip sealingly pressing one side of a respective non-beaded vertical edge against an opposing face of the side channel.

A third aspect of the invention provides a window shade assembly comprising: a headrail including a roller core wrapped with a flexible shade material having a pair of non-beaded vertical edges; a pair of opposed vertical side channels open in a direction facing one another and configured to be mounted to a surrounding frame, each side channel receiving a respective non-beaded vertical edge of the flexible shade material; and wherein an edge of a wrapping material covering a front portion of a respective side channel enters the side channel and sealingly presses one side of a respective non-beaded vertical edge against an opposing face of the side channel.

A fourth aspect of the invention provides a window shade assembly comprising: a headrail including a roller core wrapped with a flexible shade material having a pair of non-beaded vertical edges; a pair of opposed vertical side channels open in a direction facing one another and configured to be mounted to a surrounding frame, each side channel receiving a respective non-beaded vertical edge of the flexible shade material; and wherein each side channel includes a first mount portion coupled to the surrounding frame and providing a portion of the side channel, and a second cover portion positioned relative to the first mount portion completing the side channel.

The illustrative aspects of the present invention are designed to solve the problems herein described and/or other problems not discussed.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION

As indicated above, embodiments of the invention provide a window shade assembly that acts as an effective and active insulating and light-blocking member on a window, with the aesthetic benefits (including image display on a flat surface when deployed) and the ease of installation and operation of a conventional roller shade. As used herein, the term "window" may include any ventilation and/or light emitting opening in a structure of any kind.

Figure 1:
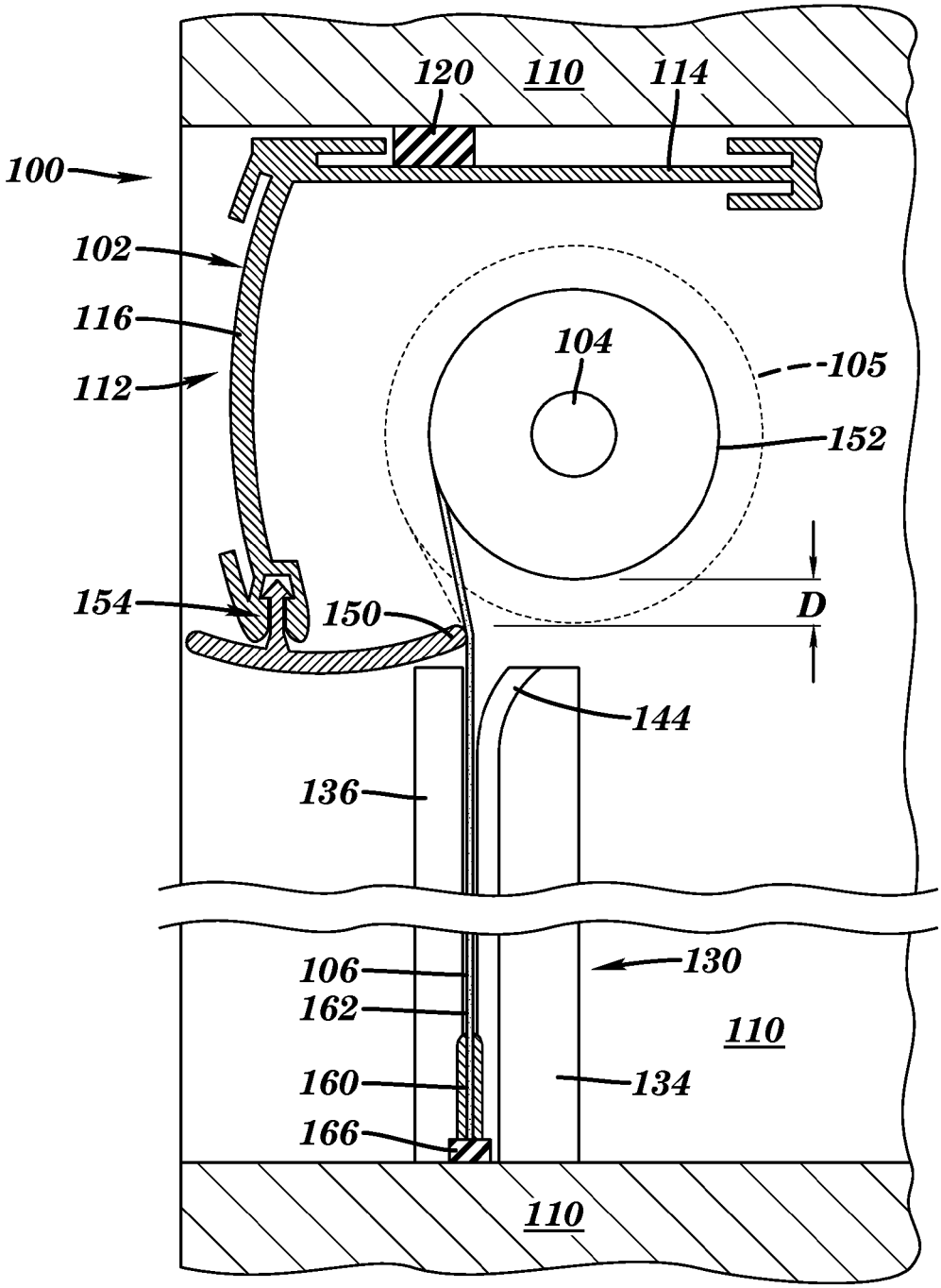
FIG. 1 shows a partial cross-sectional view in a horizontal plane through a window shade assembly according to embodiments of the invention.
Figure 3:
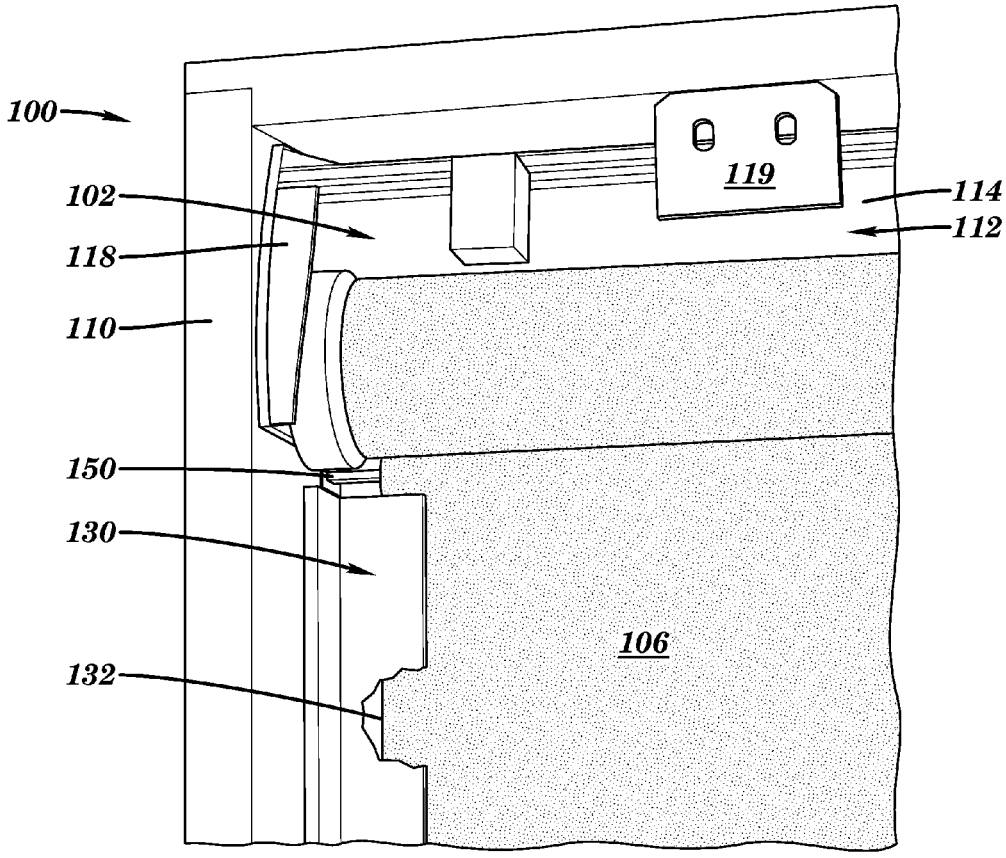
FIG. 3 shows a perspective detail view of a roller core and side channel junction.
Figure 4:
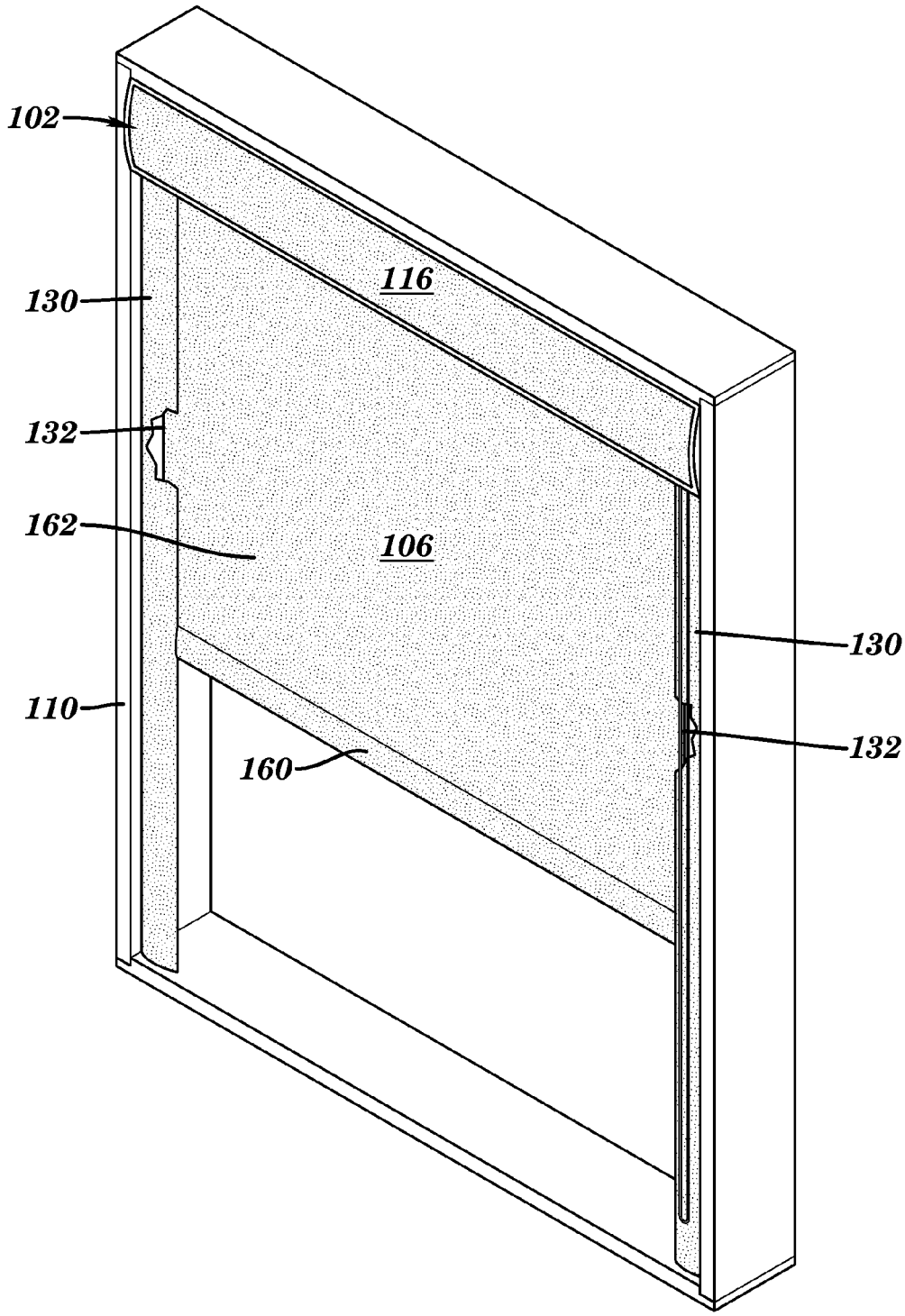
FIG. 4 shows a front perspective view of a window shade assembly.
Figure 5:
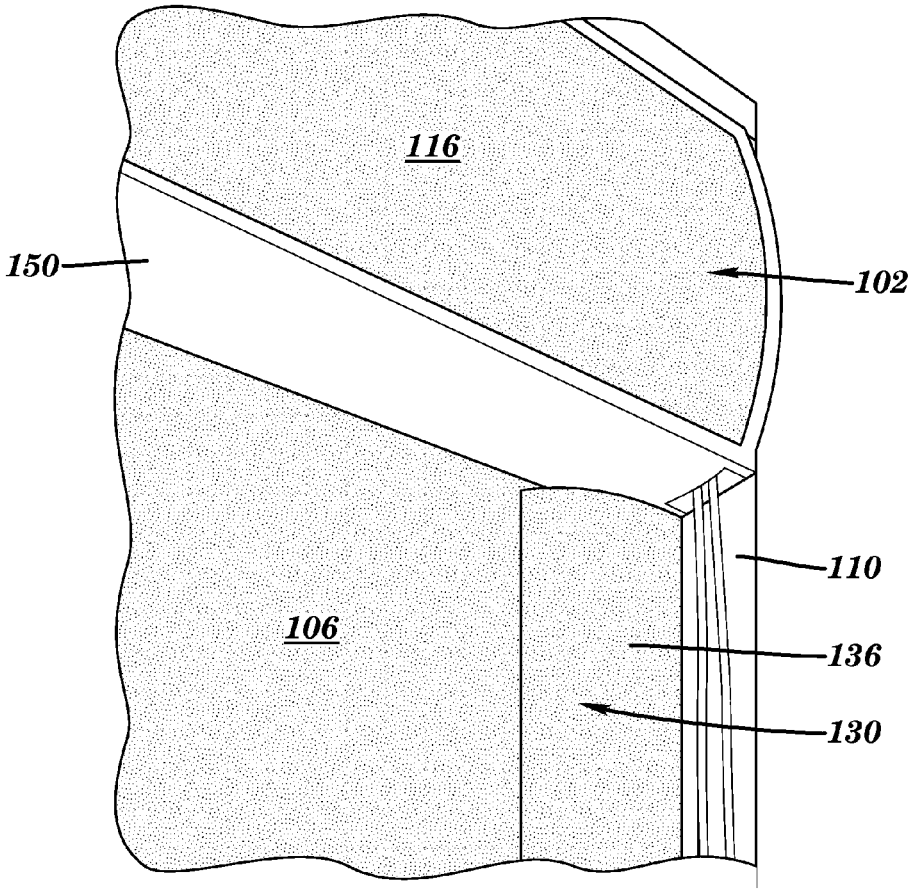
FIG. 5 shows a front perspective detail view of a side channel, lip and headrail junction of the window shade assembly.

Referring to FIG. 1, a partial cross-sectional view in a vertical plane through a window shade assembly 100 according to embodiments of the invention is provided. Window shade assembly 100 includes a headrail 102 including a roller core 104 wrapped with a flexible shade material 106. Headrail 102 may include any frame structure of hard material such as plastic or metal for mounting window shade assembly 100 to a surrounding frame 110 that defines the window for which window shade assembly 100 is to be used. As illustrated in FIGS. 1 and 3, in one embodiment, headrail 102 includes a substantially L-shaped member 112 having a first leg 114, and a downwardly extending face portion 116 that covers the mechanics of window shade assembly 100, e.g., roller core 104 and structure for moving roller core 104 such as a spring load or ratchet mechanisms, corded clutch drives, etc. (not shown) as known in the art. As known in the art, face portion 116 may be covered by a wrapping material (not shown) that matches or complements flexible shade material 106, e.g., using adhesive or grooves.

Roller core 104, shown best in FIG. 1, may include any rod-like structure capable of having flexible shade material 106 wrapped thereupon, e.g., a plastic, cardboard, wood dowel or tube. A maximum accumulation of flexible shade material 106 on roller core 104 is shown by dashed circle 105. Flexible shade material 106 may include any now known or later developed shade material such as but not limited to woven cloth (with or without polymer coatings), plastics, etc.

As shown in FIG. 3, headrail 102 may also include a pair of end plates 118 (only one shown) at opposing ends thereof. Headrail 102 may be permanently coupled to surrounding frame 110 by any now known or later developed mounting mechanism, e.g., screws, adhesives, brackets (119 in FIG. 3) or any other type of permanent mounting structure. As shown in FIG. 1, resilient gasket 120 may be employed on the top and/or sides of headrail 102 to provide a seal against heat and/or cold passage, or light passage. Resilient gasket 120 may include any now known or later developed pliant material such as a polymer, fiber pile, etc. Although a particular headrail 102 has been described herein, it is understood that the teachings of the invention are not limited to this type of headrail.

Window shade assembly 100 also includes a pair of opposed vertical side channels 130 open in a direction facing one another and configured to be mounted to surrounding frame 110. As shown best in FIGS. 2A, 2B, 3 and 4, flexible shade material 106 includes a pair of non-beaded vertical edges 132 on opposing sides thereof. Each side channel 130 receives a respective non-beaded vertical edge 132 of flexible shade material 106 such that flexible shade material 106 can lie within side channels 130 without substantial deflection from its free-hanging position (in the absence of the channels). As used herein, "non-beaded" indicates edge 132 does not have a greater thickness than the shade material 106 in a direction perpendicular to a plane of flexible shade material 106 that would prevent removal from side channels 130. Consequently, an advantage that may be realized in the practice of some embodiments of the described window shade assembly 100 is that they do not require any modification of flexible shade material edges 132, preserving uniform and compact roll-up.

Figure 2A:
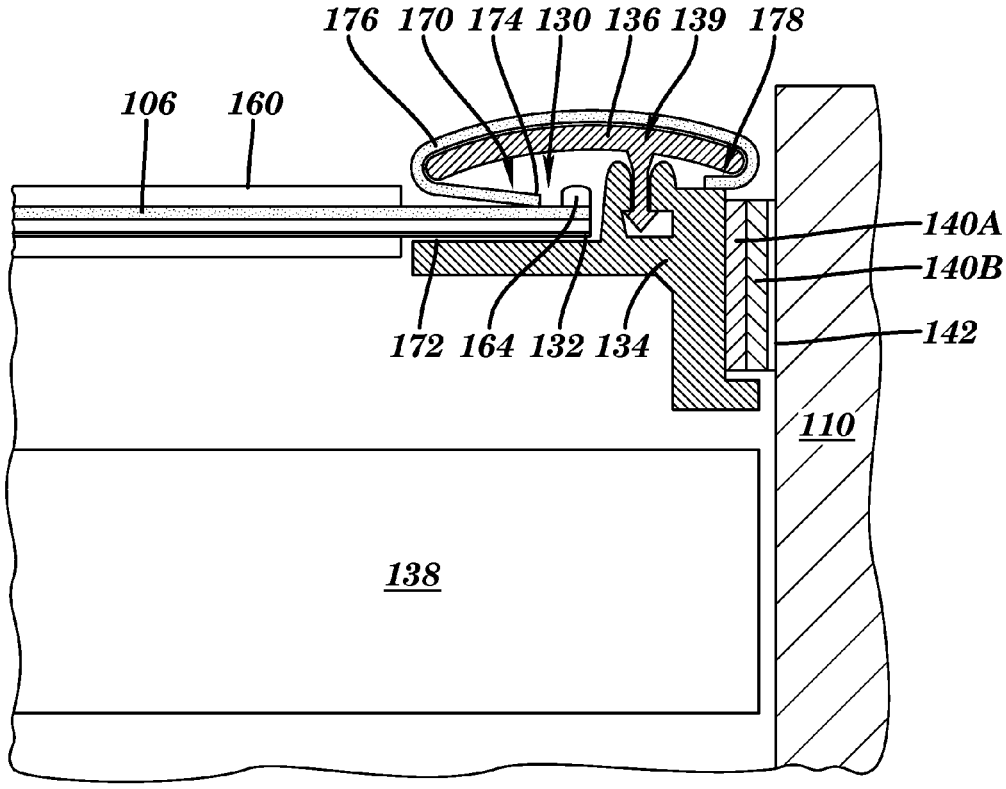
FIGS. 2A-2B show vertical cross-sectional views in a vertical plane through a window shade assembly according to embodiments of the invention.
Figure 2B:
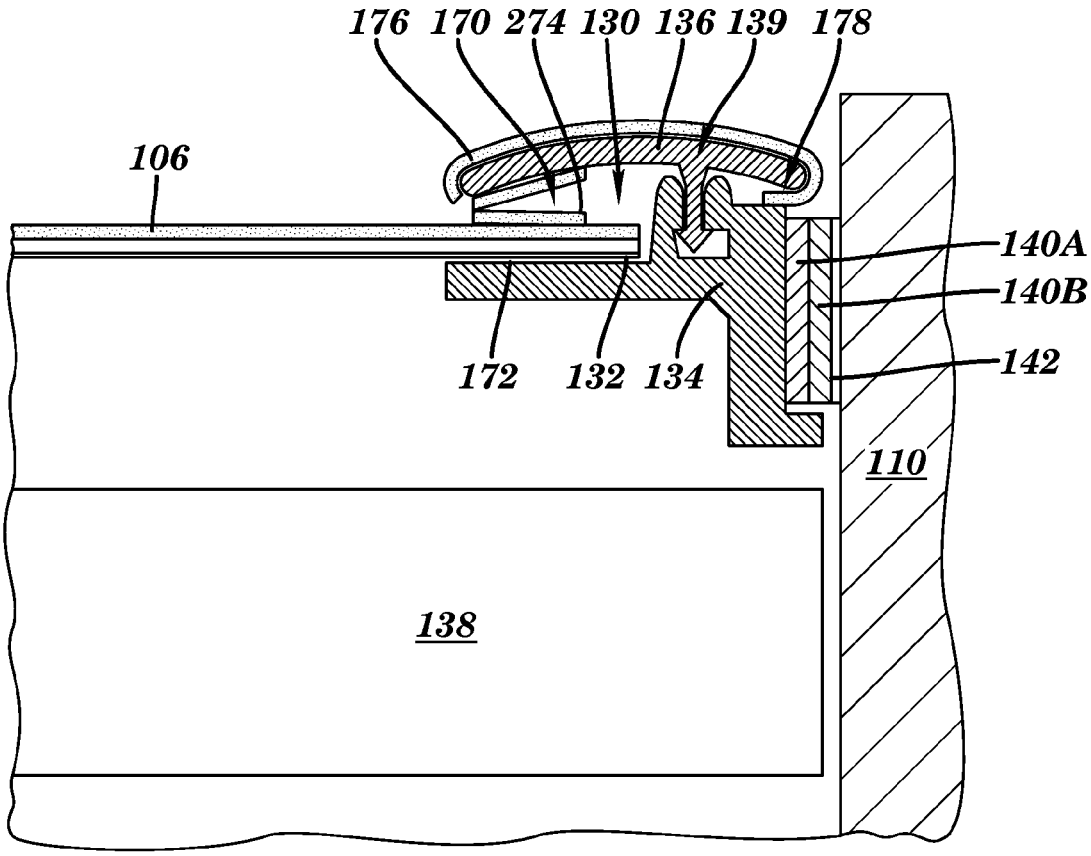

In one embodiment, as shown best in FIGS. 2A-2B, in contrast to conventional window shade systems, each side channel 130 includes two parts: a first mount portion 134 and a second cover portion 136. First mount portion 134 may be coupled to surrounding frame 110 and provides a portion of side channel 130, i.e., the back portion of a side channel 130 as illustrated. Second cover portion 136 is positioned relative to first mount portion 134 to complete side channel 130. Second cover portion 136 may be positioned relative to first mount portion 134 in a number of ways. In one embodiment, second mount portion 136 may be releasably coupled to first mount portion 134. In the example shown, second cover portion 136 is coupled to first mount portion 134 using a snap fit connection 139 including, for example, a barb on one portion and a mating cavity on the other portion. Other examples may include hook-and-latch fasteners, screws, adhesive, etc. In an alternative embodiment, not shown, second mount portion 136 could also be coupled to surrounding frame 110 in a known fashion, e.g., using fasteners such as screws or adhesive, to position it relative to first mount portion 134. An advantage that may be realized in the practice of some embodiments of the described window shade assembly 100 using portions 134, 136 is that it enables assembly by positioning a wrapping material 176 (e.g., fabric) over second cover portion 136 without having to tuck it in all along side channel 130. Also, it allows interchangeable wrapping material 176 for multiple appearance options, and allows the forming of side channel 130 with an outer depth closer to surrounding frame 110 that is greater than an inner depth closer to a center of window shade assembly 100. Consequently, flexible shade material 106 can pass entries of side channels 130, which prevents the fabric from flapping, and enters a wider internal cavity, where an edge 174 of wrapped material 176 seals. A narrow-maw, large-core cavity is difficult to extrude in one piece.

In one embodiment, first mount portion 134 is permanently coupled to surrounding frame 110 in a known fashion, e.g., using screws or adhesive or any other now known or later developed fixing structure. In an alternative embodiment, however, as shown in FIGS. 2A-2B, first mount portion 134 is removably mounted to surrounding frame 110 by, for example, mating magnet strips 140A, 140B (as described herein), hook-and-loop fasteners or other means known in the art for removable attachments. An advantage that may be realized in the practice of some embodiments of the described window shade assembly 100 using the removable mounting of first mount portion 134 is that it allows, for example, unobstructed tilting of a window sash 138 through surrounding frame 110 (where that feature is provided) when each vertical side channel 130 is removed. In one embodiment, each vertical side channel 130, i.e., first mount portion 134, is removably mounted to surrounding frame 110 by a pair of separable magnetic strips 140A, 140B. In this case, one magnetic strip 140A may be coupled to vertical side channel 130, i.e., first mount portion 134, and the other magnetic strip 140B may be coupled to surrounding frame 110. Magnetic strip 140A may be permanently, for example, adhesively, coupled to first mount portion 134 during manufacture, while magnetic strip 140B may be provided with an adhesive 142 with a peel-off layer (not shown) such that an installer can peel off the peel-off layer, adhere magnetic strip 140B to surrounding frame 110 and then magnetically couple magnetic strips 140A, 140B to position first mount portion 134. In this fashion, when window sash 138 must be accessed, e.g., for cleaning or repair, side channels 130 can be easily removed, leaving a very narrow and unobtrusive magnetic strip 140B. Consequently, sash 138 can be easily accessed, and can even tilt in where that feature is provided. When complete, first mount portion 134 and, hence, side channel 130 can be easily and accurately re-installed by re-engaging magnetic strips 140A, 140B. The process can be repeated frequently without difficulty or damage. An upper end of each side channel 130 may include a flared open end 144 (FIG. 1) through which flexible shade material 106 extends. Flared open end 144 may be created in a number of ways such as having first mount portion 134 have a curved end, as shown in FIG. 1.

In another embodiment, as shown best in FIG. 1, window shade assembly 100 includes a re-channeling system (not numbered) capable of simply and efficiently returning one or more of non-beaded vertical edges 132 to side channel(s) 130 when removed from the side channel(s). Non-beaded vertical edges 132 may be removed from side channel(s) 130 in a number of ways such as accidental application of a force perpendicular to the plane of flexible shade material 106. Re-channeling system is provided, in part, by a lip 150 positioned at a vertical distance D from an outer surface 152 of roller core 104. Vertical distance D allows all of flexible shade material 106 not over bottom rail 160 to pass ends of first mount portion 134 and second cover portion 136 and be re-positioned within side channels 130, i.e., re-channeled. Lip 150 at least partially defines a plane of flexible shade material 106 within side channels 130. That is, lip 150 spans a width (perhaps intermittently) of exposed flexible shade material 106 between side channels 130, and positions flexible shade material 106 in a substantially vertical plane that coincides with side channels 130—between first mount portion 134 and second cover portion 136. Lip 150 is also positioned horizontally such that its edge that engages flexible shade material 106 always engages flexible shade material 106 to define the above-described plane regardless of the material's tangent point with roller core 104, which may change with differing amounts of flexible shade material 106 collected on roller core 104. Note, while FIG. 1 shows an overhand unroll (as viewed from the interior), window shade assembly 100 can be made with an underhand roll also. In this case, lip 150 may be longer to properly engage flexible shade material 106. In one embodiment, lip 150 is mounted to headrail 102 by a coupling 154, which may be made in a number of ways. In one embodiment, coupling 154 includes a snap fit connection including, for example, a barb on the headrail or the lip and a mating cavity on the other of headrail and lip. Other examples may include screws, adhesive, etc. However, as shown in FIG. 3, coupling of lip 150 to headrail 102 may not be necessary in all cases, as lip 150 may provide the same positioning when mounted to surrounding frame 110, e.g. via screws or other known fasteners. An advantage that may be realized in the practice of some embodiments of the described assembly, as can be observed by comparing FIGS. 1 and 2, is that second cover portion 136 and lip 150 may have a substantially identical cross-sectional shape, which may assist in reducing manufacturing costs. Second cover portion 136 and lip 150 may include, for example, extruded plastic.

Figure 6:
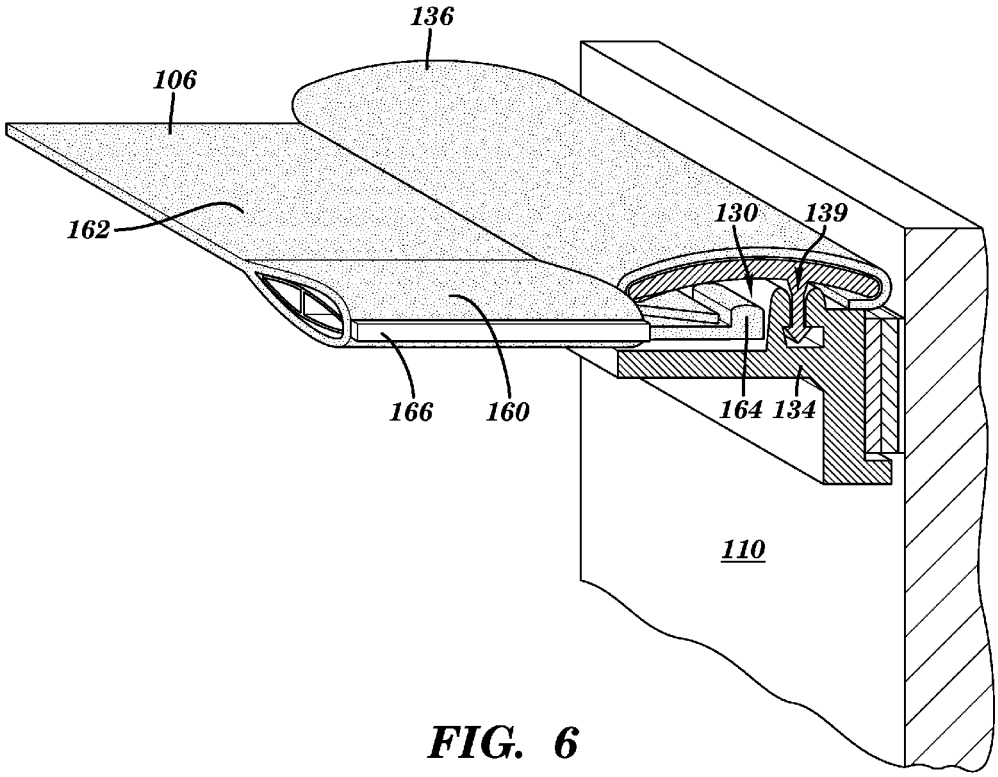
FIG. 6 shows a partial cross-sectional view of a bottom rail and side channel junction.

As shown best in FIGS. 2A and 6, the re-channeling system also may include a bottom rail 160 coupled to a free edge 162 of flexible shade material 106. Bottom rail 160 is slidingly received in each side channel 130 and provides weight and stiffness to free edge 162 to assist in lowering flexible shade material 106. In addition, bottom rail 160 may include an end member 164 at each end thereof to prevent removal from side channels 130 and provide lateral location. That is, end members 164 provide a thickness sized to fit freely within side channels 130, but with flexible shade material 106 extending to its full width at either end of bottom rail 160 and engaging with side channels 130 there. As noted above, and as shown best in FIG. 2A, side channels 130 may have an outer depth closer to surrounding frame 110 that is greater than an inner depth closer to a center of window shade assembly 100 such that end member 164 can pass entries of side channels 130, but cannot be pulled out through the narrower entry. Consequently, while non-beaded vertical edges 132 along flexible shade material 106 may be removed from side channels 130, bottom rail 160 is provided with increased resistance to dislodging and is substantially irremovable (except from ends of side channels 130, as when the side channels themselves are removed from surrounding frame 110). End members 164 may be provided in any number of ways. For example, end members 164 may include a compressed or shaped widened portion of bottom rail 160, an extension of bottom rail 160 having a widened portion or a wider insert into bottom rail 160, each of which can be wrapped with flexible shade material 106. End members 164 may be integral with bottom rail 160 or separate therefrom. Bottom rail 160 may also include a resilient gasket 166 to provide a seal against heat and/or cold passage, or light passage, when abutting surrounding frame 110, e.g., at a sill of a window. Resilient gasket 166 may include any now known or later developed pliant material such as a polymer, fiber pile, etc. Operation of re-channeling system will be described elsewhere herein.

Referring to FIGS. 2A-2B, window shade assembly 100 may also include a single resilient seal strip 170 sealingly pressing one side of a respective non-beaded vertical edge 132 against an opposing face 172 of side channel 130. As illustrated, opposing face 172 is provided by first mount portion 134; however, this may not be necessary in all cases. The use of a single resilient seal strip 170 is in contrast to conventional systems that typically use two strips (one on each side of material 106), which provide increased drag on flexible shade material 106 and may prevent gravity-feed implementation. The shape of side channel 130 with a narrower slot over flexible shade material 106 and a wider cavity (enabled in part by portions 134, 136) also reduces drag and allows for a larger travel (without an unduly wide slot that would allow flapping, leakage, and easier pull-out). Consequently, resilient seal strip 170 can have a lower spring force and lower drag without sacrificing sealing. As shown in FIG. 2A, in one embodiment, single resilient seal strip 170 may include an edge 174 of a wrapping material 176 covering a front portion of a respective side channel 130, i.e., second cover portion 136. Edge 174 is un-adhered to and wraps around second cover portion 136 to enter side channel 130 and engage non-beaded vertical edge 132. Edge 174 creates a barrier to air passage but does not create excessive drag on flexible shade material 106 as it moves (into and out of page in FIG. 2A). The amount of pressure applied by edge 174 can be controlled, for example, based on the material used, the shape of second mount portion 136, the amount of bend initially created in wrapping material 176, etc. In an alternative embodiment, shown in FIG. 2B, single resilient seal strip 170 may be provided by a V-strip 274 of, for example, plastic, which provides a similar pressure as edge 174 (FIG. 2A). Other options for providing a single resilient seal strip 170 may also be possible and are considered within the scope of the invention.

Wrapping material 176 may be coupled to second cover portion 136 in any now known or later developed fashion, e.g., adhesive, friction fit into a groove, etc. In one embodiment, however, as shown in FIGS. 2A-2B, wrapping material 176 may be held in place at least in part by engagement of first mount portion 134 and second cover portion 136, e.g., at a point 178. Adhesive between second cover portion 136 and wrapping material 176 may also be employed with this engagement. Wrapping material 176 may include a pattern thereon substantially similar to a pattern on flexible shade material 106, i.e., same pattern or an aesthetically complementary pattern.

In operation, window shade assembly 100 according to embodiments of the invention is usually operated in a manner similar to conventional roller shades, e.g., using loop cord actuators or spring loaded actuators. In one example, a loop cord actuator (not shown) is provided that rotates roller core 104 through a clutch (not shown) that holds roller core 104 in position when the loop cord is not moved. (As the structure of loop cord actuators and clutches are well known in the art, no further description is provided.) Gravity pulls downward on bottom rail 160 and flexible shade material 106, causing it to hang tautly and to drop freely, so long as friction forces between flexible shade material 106 and resilient seal strip 170 do not exceed the weight force. Use of common flexible shade materials such as woven cloth, with or without flexible polymer coatings, and known to those skilled in the art, when used for resilient seal strip 170 together with the same material in shade material have been shown to meet this freely dropping requirement. Raising the shade does not depend so much on gravity or a force balance, as flexible shade material 106 is pulled upward and accumulated onto roller core 104 by rotating in the opposite direction.

The re-channeling system according to embodiments of the invention provides a recovery mode of operation that is used when at least one of non-beaded vertical edges 132 is at least partially removed from a side channel 130. That is, edge(s) 132 of flexible shade material 106 may be displaced from their intended position within side channels 130 for a number of reasons such as but not limited to: an accidental hand, household pet or strong gust of wind pressing on the face of flexible shade material 106, bowing it and drawing in edges 132 until they are released from side channels 130. In this case, in contrast to conventional systems, no cumbersome manual re-insertion is required. Instead, as shown in dashed lines in FIG. 1, because bottom rail 160 remains engaged in side channels 130 and with it a portion of flexible shade material 106, raising the shade will draw all of the displaced flexible shade material 106 onto roller core 104, above the ends of side channels 130. In addition, lip 150 (and the ends of side channels 130) is positioned at distance D from roller core 104 to position flexible shade material 106 for re-channeling into side channels 130 upon rolling of flexible shade material 106 onto roller core 104. Consequently, lowering the shade again causes flexible shade material 106 to follow bottom rail 160 and descend again within side channels 130.

Figure 7:
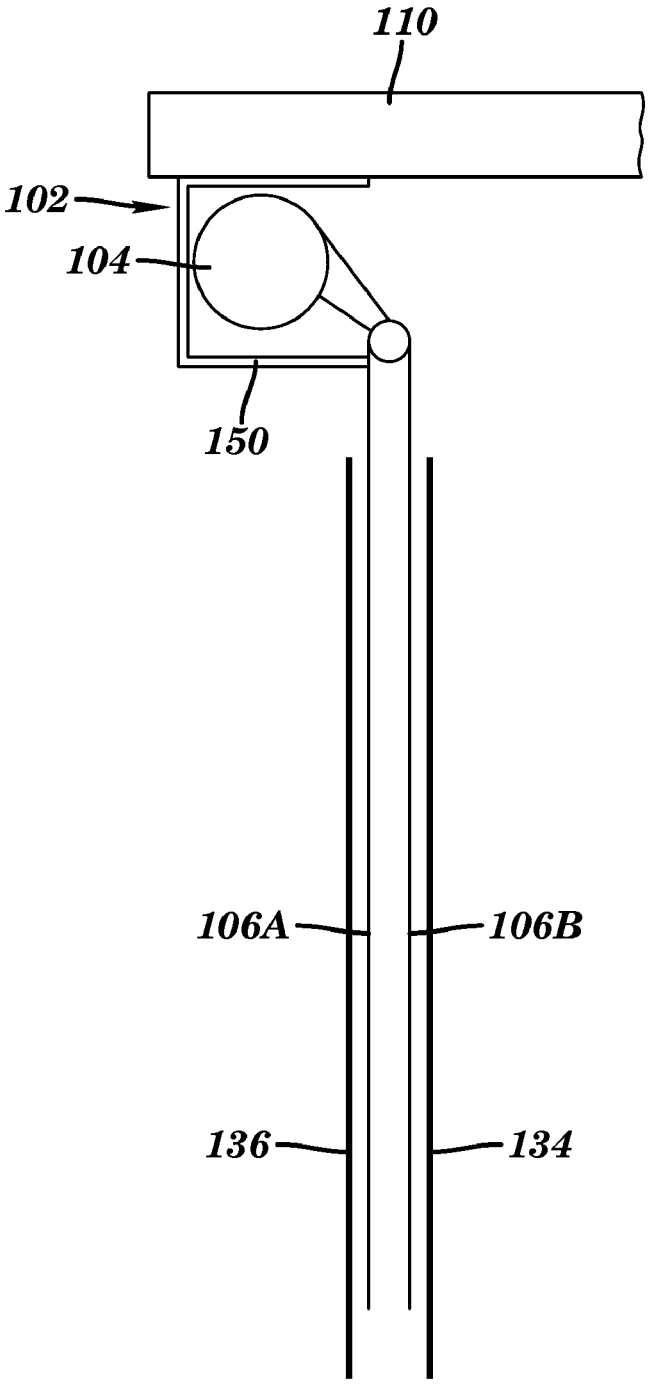
FIG. 7 shows a cross-sectional view of an alternative embodiment of a flexible shade material for a window shade assembly according to embodiments of the invention.

In an alternative embodiment, as shown in FIG. 7, flexible shade material 106 may include a plurality of flexible layers 106A, 106B having adjustable reveal openings therein such as described in U.S. Pat. No. 6,651,720 to DiSilvestro et al. or U.S. Pat. No. 6,189,592 to Domel. Embodiments of the invention as described herein may be used for the flexible shade material, retaining the features of those inventions of providing adjustable visibility through the deployed shade (i.e., when unrolled and covering the window) by relative vertical movement of the plurality of layers controlled by incremental rotation of the roller core. In such an embodiment, provision is made at the bottom rail to contain the bight of Domel or the two weighted rails of DiSilvestro, without otherwise affecting the operation or components of embodiments of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A window shade assembly comprising:

a headrail including a roller core wrapped with a flexible shade material having a pair of non-beaded vertical edges;

a pair of opposed vertical side channels open in a direction facing one another and configured to be mounted to a surrounding frame, each vertical side channel slidingly receiving a respective non-beaded vertical edge of the flexible shade material, wherein each vertical side channel includes:

a mounted portion coupled to the surrounding frame, the mounted portion including a back portion of each vertical side channel having a rear surface positioned substantially adjacent a window sash; and a cover portion coupled to the mounted portion, the cover portion including a front portion of each vertical side channel having a front surface opposite the rear surface of the mounted portion; and a single resilient seal strip sealingly pressing one side of a respective non-beaded vertical edge against the mounted portion of the vertical side channel, wherein the single resilient seal strip includes an edge of a wrapping material that enters the side channel, the wrapping material covering an entirety of the front surface of the cover portion of each of the vertical side channels.

2. The window shade assembly of claim 1, further comprising:

a lip positioned at a vertical distance from an outer surface of the roller core to define a plane of the flexible shade material within the side channels; and a bottom rail coupled to a free edge of the flexible shade material, an end of the free edge at the bottom rail slidingly received in each side channel, whereby in response to at least one of the non-beaded vertical edges being at least partially removed from a side channel, the lip and bottom rail position the flexible shade material for re-channeling into the side channels upon rolling of the flexible shade material onto the roller core.

3. The window shade assembly of claim 2, wherein an upper end of each side channel includes a flared open end through which the flexible shade material extends.

4. The window shade assembly of claim 1, wherein an edge of a wrapping material covering a front portion of a respective side channel enters the side channel and sealingly presses one side of a respective non-beaded vertical edge against an opposing face of the side channel.

5. The window shade assembly of claim 1, wherein the flexible shade material includes a plurality of flexible layers having adjustable reveal openings therein.

6. The window shade assembly of claim 1, wherein the wrapping material includes a pattern thereon substantially similar to a pattern on the flexible shade material.

7. The window shade assembly of claim 1, wherein the single resilient seal strip is configured to allow the non-beaded vertical edge of the flexible shade material to move vertically within the vertical side channel.

8. A window shade assembly comprising:

a headrail including a roller core wrapped with a flexible shade material having a pair of non-beaded vertical edges;

a pair of opposed vertical side channels open in a direction facing one another and configured to be mounted to a surrounding frame, each vertical side channel slidingly receiving a respective non-beaded vertical edge of the flexible shade material, wherein each vertical side channel includes:

a back portion having a rear surface positioned substantially adjacent a window sash; and a front portion having a front surface opposite the rear surface of the back portion; and a wrapping material covering an entirety of the front surface of the front portion of each of the vertical side channel, the wrapping material including an edge that enters the vertical side channel and sealingly presses one side of a respective non-beaded vertical edge against an opposing face of the vertical side channel.

9. The window shade assembly of claim 8, further comprising:

a lip positioned at a vertical distance from an outer surface of the roller core to define a plane of the flexible shade material within the side channels; and a bottom rail coupled to a free edge of the flexible shade material, an end of the free edge at the bottom rail slidingly received in each side channel, whereby in response to at least one of the non-beaded vertical edges being at least partially removed from a side channel, the lip and bottom rail position the flexible shade material for re-channeling into the side channels upon rolling of the flexible shade material onto the roller core.

10. The window shade assembly of claim 9, wherein an upper end of each side channel includes a flared open end through which the flexible shade material extends.

11. The window shade assembly of claim 8, wherein the wrapping material includes a pattern thereon substantially similar to a pattern on the flexible shade material.

12. The window shade assembly of claim 8, wherein the edge of the wrapping material is configured to allow the non-beaded vertical edge of the flexible shade material to move vertically within the vertical side channel.

* * * * *